US007200936B2

(12) United States Patent
Coffin et al.

(10) Patent No.: US 7,200,936 B2
(45) **Date of Patent: *Apr. 10, 2007**

(54) SHAVING AID DISPENSER SYSTEM FOR USE IN A WET SHAVING RAZOR

(75) Inventors: David C. Coffin, Hamden, CT (US); Raymond Guimont, Guilford, CT (US)

(73) Assignee: Eveready Battery Company, Inc., St. Louis, MO (US)

( * ) Notice: Subject to any disclaimer, the term of this patent is extended or adjusted under 35 U.S.C. 154(b) by 262 days.

This patent is subject to a terminal disclaimer.

(21) Appl. No.: 10/819,642

(22) Filed: Apr. 7, 2004

(65) Prior Publication Data

US 2005/0108879 A1 May 26, 2005

Related U.S. Application Data

(60) Provisional application No. 60/460,922, filed on Apr. 7, 2003.

(51) Int. Cl.
*B26B 21/44* (2006.01)
*B26B 21/08* (2006.01)

(52) U.S. Cl. ..... 30/41; 30/41.5; 156/577

(58) Field of Classification Search ..... 30/41, 30/41.5; 222/290, 403, 405, 516, 407; 401/261, 401/264, 266, 191; 132/108, 317; 156/577
See application file for complete search history.

(56) References Cited

U.S. PATENT DOCUMENTS 2,423,245 A 7/1947 Magnus et al.
4,074,429 A * 2/1978 Roberts ..... 30/41
4,170,821 A 10/1979 Booth
4,238,882 A * 12/1980 Harrison, Sr. ..... 30/41
4,562,644 A * 1/1986 Hitchens ..... 30/41
4,872,263 A * 10/1989 Etheredge, III ..... 30/41
4,875,287 A * 10/1989 Creasy et al. ..... 30/34.05
5,005,287 A 4/1991 Ritter
5,168,628 A 12/1992 Mock et al.
5,310,437 A * 5/1994 Tucker ..... 156/238
5,903,979 A * 5/1999 Oldroyd ..... 30/41
5,956,849 A * 9/1999 Chadwick et al. ..... 30/41
6,499,524 B1 * 12/2002 Miller et al. ..... 156/577
6,655,028 B2 * 12/2003 Coffin ..... 30/41
6,807,739 B2 * 10/2004 Follo ..... 30/527
2002/0157255 A1 10/2002 Coffin

FOREIGN PATENT DOCUMENTS

CH 682041 A5 7/1993

* cited by examiner

*Primary Examiner*—Boyer D. Ashley
*Assistant Examiner*—Landrum Edward
(74) *Attorney, Agent, or Firm*—Michaud-Duffy Group LLP

(57) ABSTRACT

The present invention is directed in one aspect to a razor cartridge having a shaving aid dispensing system that includes a housing that defines a cavity in which a supply of shaving aid film is disposed. At least one razor blade is positioned within the housing and has an at least partially exposed cutting edge. The supply of shaving aid film is positioned in the cavity and is used to transfer shaving aid to a user's skin during a shaving operation. An applicator is coupled to the housing adjacent the cutting edge of the razor blade. shaving aid film is drawn over the applicator in response to the razor cartridge being moved over, and in contact with, a user's skin during a shaving operation. The shaving aid film deposits at least a portion of the shaving aid provided onto the user's skin.

42 Claims, 7 Drawing Sheets

SHAVING AID DISPENSER SYSTEM FOR USE IN A WET SHAVING RAZOR

CROSS-REFERENCE TO RELATED APPLICATIONS

This application is entitled to the benefit of and incorporates by reference essential subject matter disclosed in Provisional Patent Application No. 60/460,922 filed on Apr. 7, 2003.

FIELD OF THE INVENTION

This invention relates in general to razors used in wet shaving operations, and more particularly to razors that dispense shaving aid during a shaving operation.

BACKGROUND OF THE INVENTION

As used herein, the term "shaving aid" is to be broadly construed to include shaving creams, soaps, gels and foams, as well as any other pre-, mid- or post-shaving skin preparations, such as, but not limited to, lotions, aftershaves, perfumes, balms, razor cleaners, whisker softeners, cosmetic agents or other medicinal skin applications, and combinations thereof. The term "shaving aid" also refers equally either to the active ingredient combined with a delivery system, such as a water-insoluble microporous matrix structure, or to the active ingredient alone. Previously suggested active ingredients include those in U.S. Pat. No. 4,170,821 to Booth, which is hereby incorporated by reference.

Over the years, many improvements have been made to razors in order to make such razors more comfortable to use and more efficient at their intended task. Towards this end, some wet shaving razors incorporate systems for dispensing shaving aids that can be applied before, during and/or after shaving. Shaving aids are applied to the skin surface for various reasons. For example, shaving cream, soap, gel or foam is typically applied by a user prior to shaving to soften the hair to be cut and to lubricate the skin surface. Lotions, balms and other medicinal skin applications are often used to relieve skin irritation caused by shaving. Perfumes, scented aftershaves and other cosmetic agents are often applied after shaving.

Shaving aid preparations are typically applied to the skin surface in several ways: (1) via manual application of gels, creams or lotions before or after shaving; (2) through lubrication or comfort strips attached to the razors; or (3) with devices added to the razor assembly that deliver materials through conventional means such as aerosols, squeeze tubes, pumps and the like.

Existing means for applying shaving aid preparations to the skin surface have drawbacks that affect the shaving performance of the razors with which such means are used. For example, shaving aid is often inconsistently and uncontrollably applied to the skin surface both during a shaving operation and through the life of the razor cartridge. Further, the provision of shaving aid often interferes with the effectiveness of the razor by, for example, creating waste or shaving debris that dogs the razor cartridge and blocks the cutting edges of the razor blades. Additionally, the shaving aid delivery means often are not coordinated with the life of the razor blades such that the shaving aid supply is exhausted before the razor blades wear down, or, alternatively, the blades may be dulled before the shaving aid supply is exhausted.

There exists a need in the art for a more efficacious means of delivering and dispensing shaving aids that not only accomplishes the objective of lubricating, soothing or treating the hair and skin surface, but also one which may be more controllably fixed to the razor cartridge. There also exists a need for a shaving aid dispenser system that efficiently applies shaving aid during a shaving operation without interfering with the razor blades or creating excess waste. Moreover, there exists a need in the art for a mechanism by which a user may determine if the lubrication strip has been depleted prior to its use.

With the foregoing problems and concerns in mind, it is the general object of the present invention to provide a shaving aid dispenser system for razors which overcomes or improves upon the above-described drawbacks.

SUMMARY OF THE INVENTION

The present invention is directed in one aspect to a razor cartridge having a shaving aid dispensing system that includes a housing that defines a cavity in which a supply of shaving aid film is disposed. At least one razor blade is positioned within the housing and has an at least partially exposed cutting edge. The supply of shaving aid film is positioned in the cavity and is used to transfer shaving aid to a user's skin during a shaving operation. An applicator is coupled to the housing adjacent the cutting edge of the razor blade. Means provide an application path for drawing the shaving aid film over the applicator in response to the razor cartridge being moved over, and in contact with, a user's skin during a shaving operation. The shaving aid film deposits at least a portion of the shaving aid provided thereon, onto the user's skin when contact is made therewith.

In the preferred embodiment of the present invention, the means defining an application path for the shaving aid film includes a supply reel rotatably supported within the cavity, the supply of shaving aid film being wound about the supply reel. A take-up reel is also rotatably positioned within the cavity for collecting used shaving aid film thereon. The shaving aid film extends from the supply reel, over at least a portion of the applicator to the take-up reel.

The shaving aid dispenser system of the present invention may be used in a replaceable razor cartridge that is releasably attachable to a razor handle. Alternatively, the shaving aid dispenser system can be incorporated into a one-piece razor having a handle integral with the razor cartridge. Still further, the shaving aid dispenser system of the present invention may be replaceable itself within the razor cartridge so as to replenish spent shaving aid film.

The applicator can assume different forms. In one embodiment of the present invention, the applicator includes a roller mounted in an opening in the cartridge housing proximate the razor blade. The shaving aid film is fed around the roller so that a portion of the film is exposed outside the razor cartridge and may contact the user's skin when the razor cartridge is applied thereto. In another embodiment of the present invention, the applicator can be a beak-like projection around which the shaving aid film is fed.

The present invention provides a means by which a hirsute surface is coated with pre-shave, mid-shave, or post-shave preparations that can enhance the shaving process and/or skin care, and reduce discomfort and irritation during shaving.

The present invention also provides an efficient method of delivering shaving aids to the skin surface during the shaving process, saving time for the user without compromising the quality of the shave or the effectiveness of the shaving aid application.

DETAILED DESCRIPTION OF THE PREFERRED EMBODIMENTS

Figure 1:
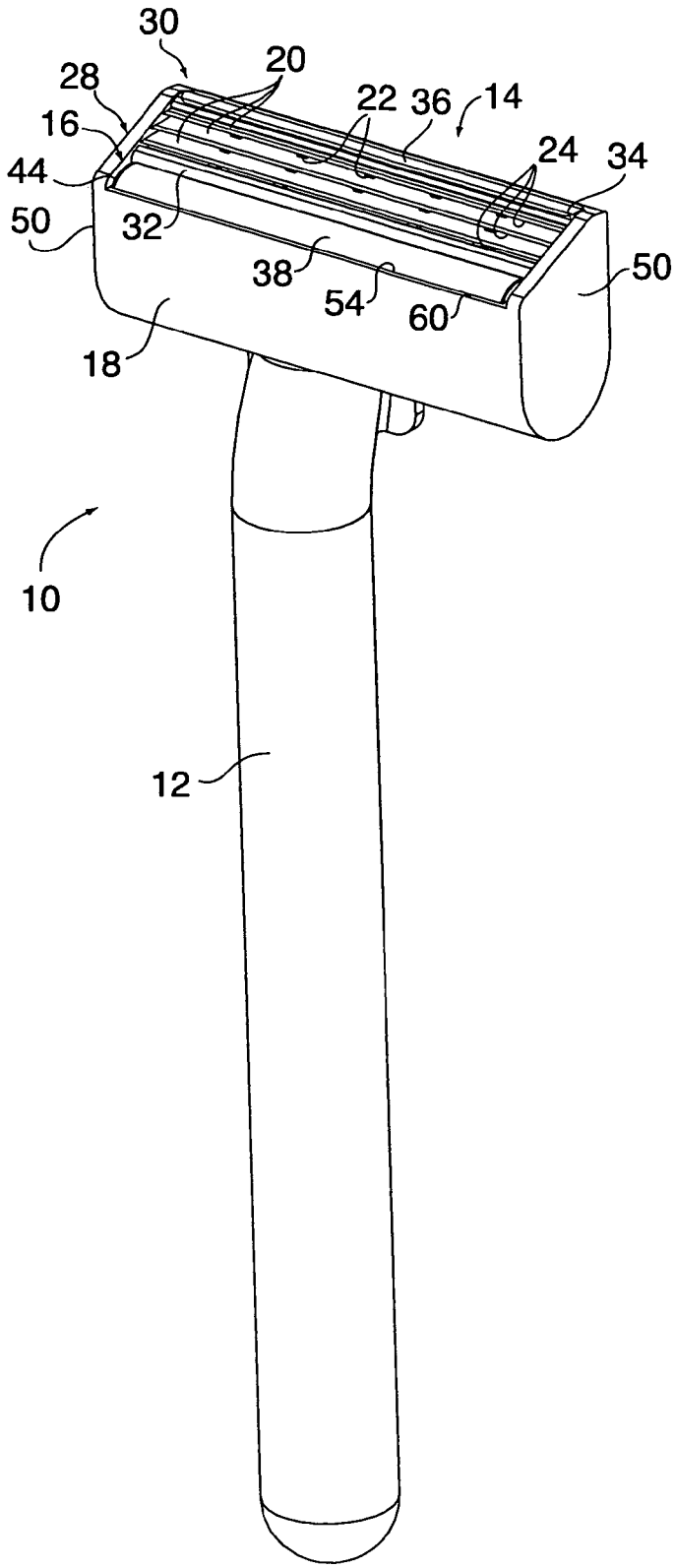
FIG. 1 is a perspective view of a wet shaving razor incorporating one embodiment of the present invention.

As shown in FIG. 1, a razor, generally designated by the reference numeral number 10, includes a handle 12, a replaceable razor cartridge 14 releasably and pivotally connected thereto, as is generally known in the art, and a shaving aid dispenser system 16, which, in accordance with certain embodiments of the present invention, is mounted within the razor cartridge 14.

The razor cartridge 14 comprises a housing 18 in which multiple razor blades 20 are mounted, generally parallel to and offset from one another in support ribs 22 formed in the cartridge housing 18. The blades 20 have respective cutting edges 24 which are preferably aligned to define a shave plane, generally illustrated as line 26, and at least partially exposed.

The razor cartridge 14 has a leading surface 28 and a trailing surface 30. As used herein, the terms "leading surface" and "trailing surface" denote the surfaces that one or more hairs protruding from the skin surface will encounter first and last respectively when the razor cartridge 14 is drawn over the skin surface during a shaving stroke in the direction indicated by arrow A. The shave plane 26 extends between the leading surface 28 and the trailing surface 30, and correspondingly has a leading side towards which the cutting edges 24 of the blades 20 are preferably directed, and a trailing side. The leading surface 28 includes a guard bar 32 for stretching and smoothening the skin before it encounters the blades 20. The guard bar 32 can be a separate component, as illustrated, or can be integral with the razor cartridge 14. The cartridge 14 also includes a cap 34 provided on the trailing surface 30 which forms a part of the housing 18 and encloses the blades 20 therein. As shown, the cap 34 is arranged above and in back of the top-most blade 20, and includes an additional shaving aid comfort strip 36, as is generally known in the art, for treating the skin after encountering the blades 20 in combination with the shaving aid dispenser system 16. However, the present invention is not limited in this regard as the cap can also be free of a comfort strip, or even replaced by another shaving aid dispenser system 16.

Figure 8:
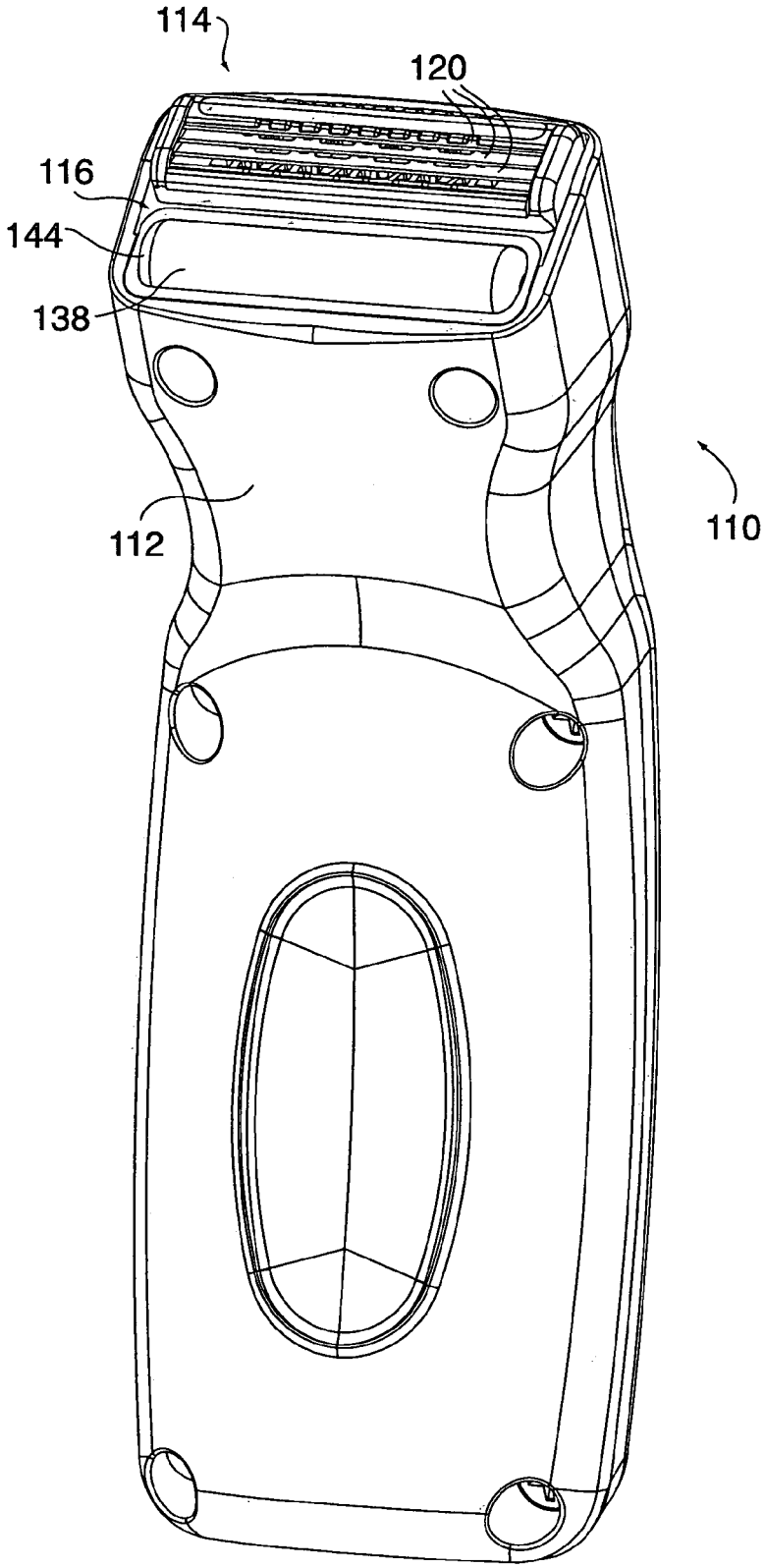
FIG. 8 is a perspective view of an alternate wet shaving razor assembly incorporating a shaving aid dispenser system in accordance with the present invention.

While a razor 10 has been shown to include three blades 20, the present invention is not limited in this regard, and razors having more or less than three blades are equally contemplated by the present invention. In addition, the present invention is not limited as to the specific type or structural form of razor shown in FIG. 1, the present invention being equally adaptable to a single use razor, a razor having a replaceable cartridge, or the like, without departing from the broader aspects of the present invention. Further, the present invention may be embodied in a razor where the handle and razor cartridge are integrally connected, for example, as illustrated in FIG. 8.

A shaving aid dispenser system 16 in accordance with the present invention is preferably incorporated within the razor cartridge housing 18. The shaving aid dispenser system 16 generally comprises a supply strip of shaving aid film 38, a supply reel 40, a take-up reel 42, and an applicator 44. The housing 18 defines a cavity 46 in which the supply reel 40 and the take-up reel 42 are mounted and supported for rotation about generally parallel axes. Specifically, the supply reel 40 is mounted on a supply spindle 48 extending between side walls 50 of the housing 18. Similarly, the take-up reel 42 is mounted on a take-up spindle 52 extending between the side walls 50. With the exception of an opening 54 formed in the leading surface 28 of the cartridge 14 proximate the blades 20, the cavity 46 is substantially enclosed. The applicator 44, which may be a roller, is coupled to the housing 18 so that a portion of the applicator 44 extends outwardly from the opening 54.

The shaving aid dispenser system 16 preferably defines an application path for drawing the shaving aid film over the applicator 44 in response to the razor cartridge 14 being moved over and in contact with the user's skin during a shaving operation. The strip of shaving aid film 38 is initially wound around the supply reel 40. The leading end of the film 38 is attached to the take-up reel 42, while the trailing end of the film 38 preferably remains attached to the supply reel 40 to ensure tension on the film 38 as it is wound around and transferred between the supply reel 40, the applicator 44 and the take-up reel 42.

Figure 3:
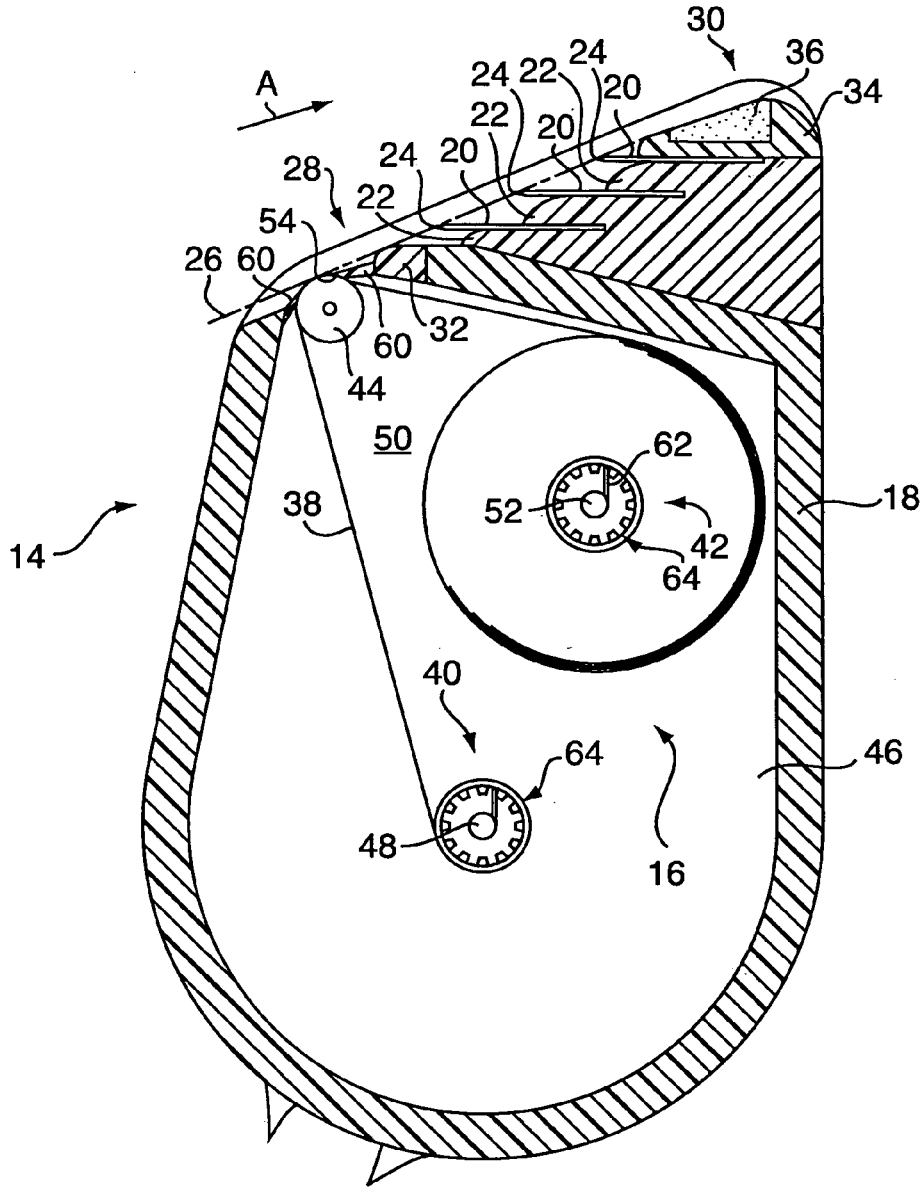
FIG. 3 shows the shaving aid dispenser system of FIG. 2 with used base substrate from the shaving aid film wound around the take-up reel.
Figure 4:
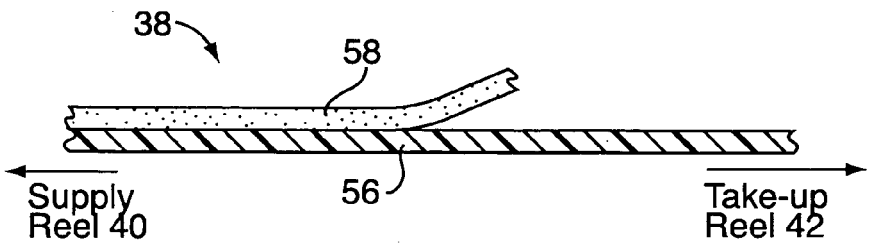
FIG. 4 is a cross-sectional representation of shaving aid film that may be used with the present invention.

The shaving aid film 38 preferably comprises a shaving aid composition deposited or otherwise provided on a base substrate 56. As shown more particularly in FIG. 4, a shaving aid layer 58 is coated onto the base substrate 56. The shaving aid composition is released and deposited onto the skin surface by friction between the film 38 and the skin surface during a shaving operation. Alternatively, the shaving aid can be activated by other external environmental conditions, such as the presence of water or reaction to a temperature. In the illustrated embodiment, the applicator 44 presses the shaving aid layer 58 against the skin surface before the skin surface encounters the blades 20. As the shaving aid composition is released onto the skin surface, the shaving aid film 38 is advanced between the supply reel 40 and the take-up reel 42. The base substrate 56 feeds around the applicator 44 and winds around the take-up reel 42. FIG. 3 shows a used razor cartridge 14 of the present invention with the spent base substrate 56 collected around the take-up reel 42.

The shaving aid dispenser system 16 of the present invention may be replaceable within the razor cartridge 14 after the shaving aid film 38 has been depleted. For example, when the entire length of shaving aid film 38 is used, the base substrate 56 is wound around the take-up reel 42. The take-up reel 42 and the supply reel 40 may be removed from the respective take-up and supply spindles 52, 48 and replaced with new reels having a new length of shaving aid film 38.

The amount of shaving aid film 38 contained in the shaving aid dispenser system 16 may correlate to the expected life of the razor blades 20 so that when the shaving aid film 38 is exhausted, the user will know that the blades 20 are worn and the razor cartridge 14 needs to be replaced. Still further, the razor blades 20, or a distinct razor cartridge 14 may be replaceable separate from the shaving aid dispenser system 16 so as to maximize the operable life of the shaving aid film 38. To this end, the shaving aid dispenser system 16 may be incorporated in a separate housing than the razor cartridge housing 18, where the two housings may be coupled together during shaving. Further, the shaving aid dispenser system 16 may be embodied in the handle of a razor while the razor cartridge is detachably connected to the handle.

In general, the present invention provides for the exposure and release of shaving aid compositions during shaving. Numerous variations of applying the shaving aid layer 58 to the base substrate 56 and releasing the shaving aid layer 58 to the skin surface are encompassed by the present invention. Most commonly, the shaving aid layer 58 is coated, deposited or extruded onto the base substrate 56 in accordance with known coating techniques, including, but not limited to barrier film coating, barrier varnish coating, knife over roll coating, and slot die or extrusion coating. Alternatively, the present invention may incorporate techniques of microencapsulation and controlled release microcapsules, microspheres, nanopartides or microcells of shaving aid. Other means include, but are not limited to, the use of a reservoir of liquid shaving aid in the cavity 46 where the film 38 passes through the reservoir and accumulates shaving aid prior to exiting the opening 54. The film 38 may comprise a continuous loop of the base substrate 56 positioned around guide rollers, including reels 40, 42, defining an application path through the reservoir and around the applicator 44 for application of shaving aid to the user's skin. In such embodiments, the base substrate 56 or the film 38 may be an absorbent material to ensure that a sufficient amount of shaving aid is applied to the user's skin.

Figure 2:
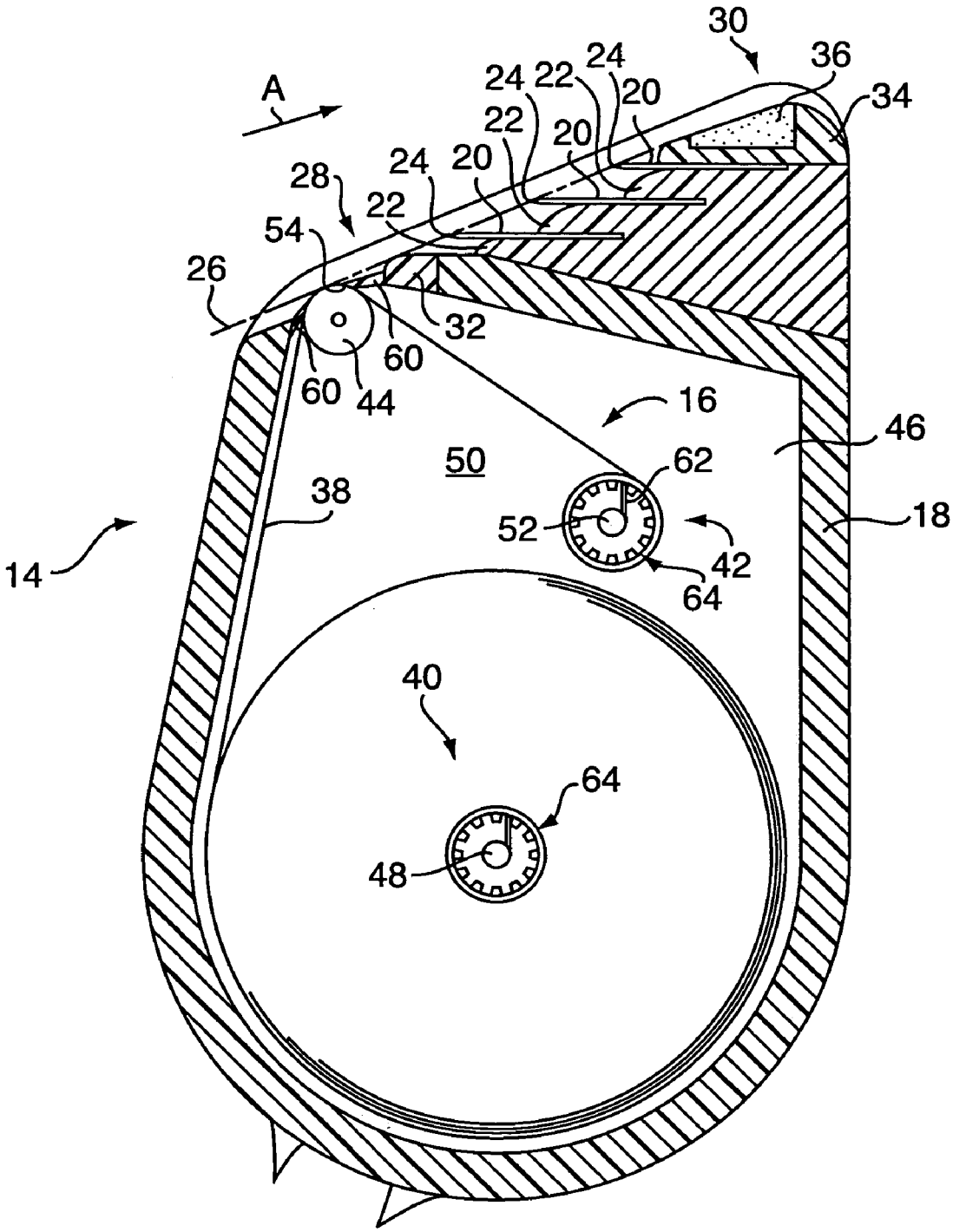
FIG. 2 is a cross-sectional view of a razor cartridge showing a shaving aid dispenser system in accordance with an embodiment of the present invention and having a full roll of shaving aid film wound on the supply reel.

As shown in FIG. 2, the film 38 is fed from the supply reel 40 out of the cavity 46 through the opening 54, drawn around the applicator 44 in the direction of arrow A, back through the opening 54 into the cavity 46, and around the take-up reel 42. As so fed, the film 38 may contact the user's skin surface as the razor cartridge 14 is drawn across the skin surface. The shaving aid composition is applied as the film 38 contacts the skin surface. The contact between the shaving aid film 38 and the skin surface, in combination with typical shaving movement of the razor cartridge 14, also advances the film 38 between the reels 40, 42. The used film—i.e., the base substrate 56 after the shaving aid has been removed—is then wound on the take-up reel 42. The opening 54 in the cavity 46, in which the applicator 44 is positioned is preferably provided with a pair of elastomeric seals 60 to keep the cavity 46 free of water or other exterior influences to prevent early degradation of the shaving aid film 38.

Preferably, the rotation of the reels 40, 42 is coordinated so that a desired tension is maintained on the film 38. That is, the rotation of, for example, the take-up reel 42 will effect rotation of the supply reel 40 to advance the film 38 along the application path of the present invention. The take-up reel 42 can be operatively connected to the supply reel 40, for example with a drive mechanism comprising gears or a drive belt, so that rotation of one reel will effect rotation of the other reel. Alternatively, at least the take-up reel 42 and spindle 52 can be biased so as to maintain a tension on the base substrate 56 and prevent slack in the shaving aid film 38. One or both reels (or spindles) can be provided with a ratcheting or similar device to prevent rotation in the opposite direction.

The film 38 will typically be advanced only when it contacts the skin surface. That is, the friction between the skin surface and the shaving aid film 38 will operate to advance the film 38 as the razor cartridge 14 is drawn across the skin surface in direction A. In the systems discussed above, slack in the film 38 will be mitigated by the maintenance of tension in the film 38.

Referring to FIG. 2, the take-up reel 42 embodies a spring-bias mechanism 62. Both the supply reel 40 and the take-up reel 42 are provided with ratcheting systems, generally designated as reference numeral 64, to restrict rotation to a clockwise direction so the shaving aid film 38 is only advanced in the A direction. Referring to the alternate embodiment of FIG. 5, the supply reel 40 and the take-up reel 42 are operatively connected by gears 66 which coordinate rotation between the reels. The gears 66 are shown as a general illustration of a drive mechanism that can coordinate the respective rotations of the supply reel 40 and the take-up reel 42, and the present invention need not be limited to the specific arrangement of the gears 66. Coordination between the reels 40, 42 is needed when the amount of film 38 on the respective reels is uneven and the rate of rotation between the two reels may be different. Several known mechanisms for coordinating the rotation of the reels 40, 42 may be used in the present invention, in combination with the gears 66, or in separate designs, including a clutching mechanism, an intermediate gear to take up the slack of the film 38, or friction wheel drives associated with each of the spindles 48, 52. Referring to the alternate embodiment of FIG. 6, the gears 66 are replaced by a belt 68 operatively engaged with the supply spindle 48 and the take-up spindle 52, as well as a clutch mechanism (not shown), to coordinate rotation between the supply reel 40 and the take-up reel 42.

The applicator 44 supports the film 38 as it is pressed and applied against the skin surface. In FIG. 2, the applicator 44 is a roller mounted for rotation in the housing 18. Rotation of the roller can assist the advancement of the film 38 where sufficient friction between the roller and the back surface of the base substrate 56 cooperates with the friction between the shaving aid layer 58 and the skin surface. The roller 44 also aids in releasing the shaving aid layer 58 from the base structure 56 as the film 38 is drawn over the roller 44. In effect, the shaving aid layer 58 can "peel" away from the base substrate 56 as the shaving aid film 38 is tensioned and advanced.

Figure 5:
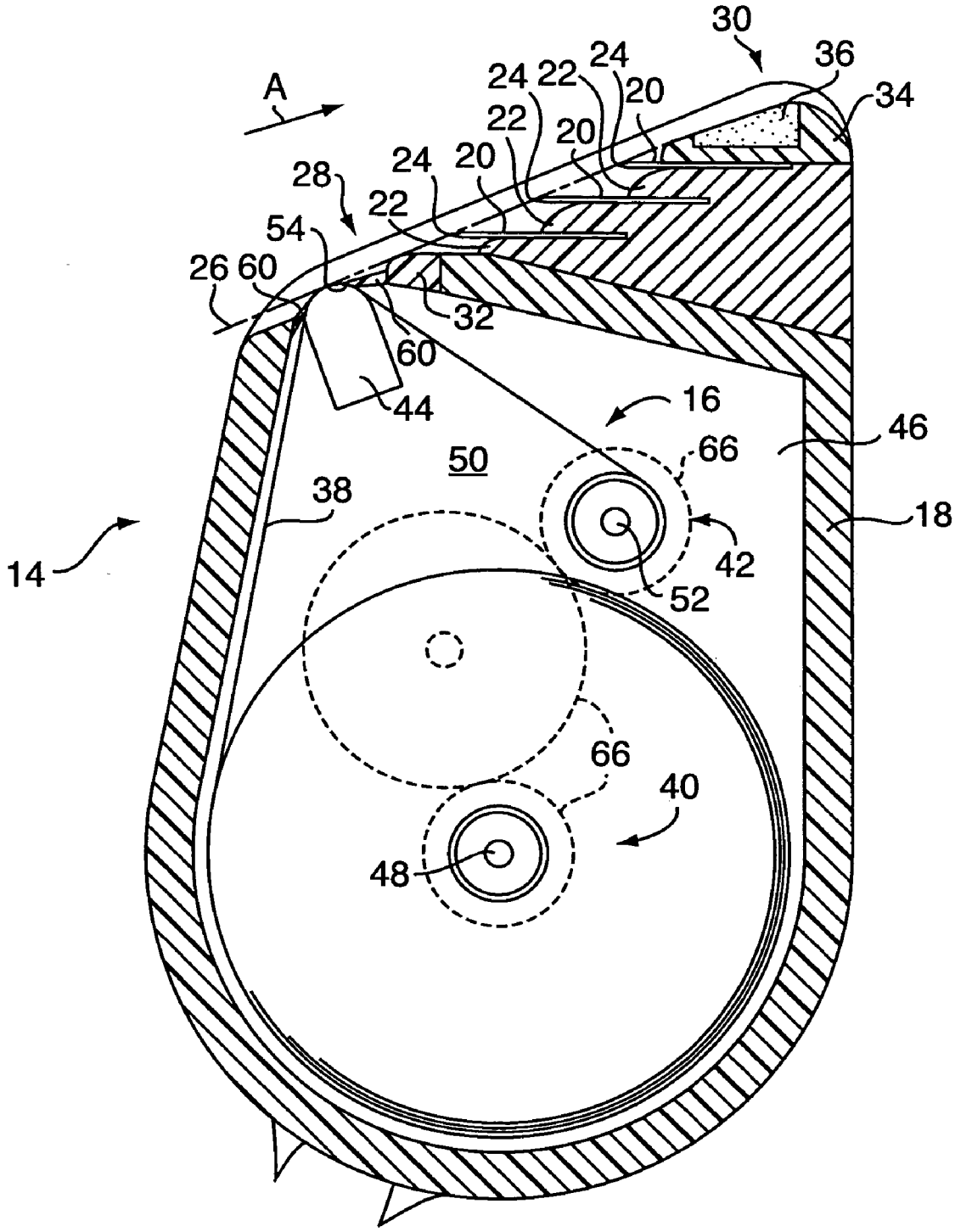
FIG. 5 is a cross-sectional view of a razor cartridge showing a shaving aid dispenser in accordance with an alternate embodiment of the present invention.
Figure 6:
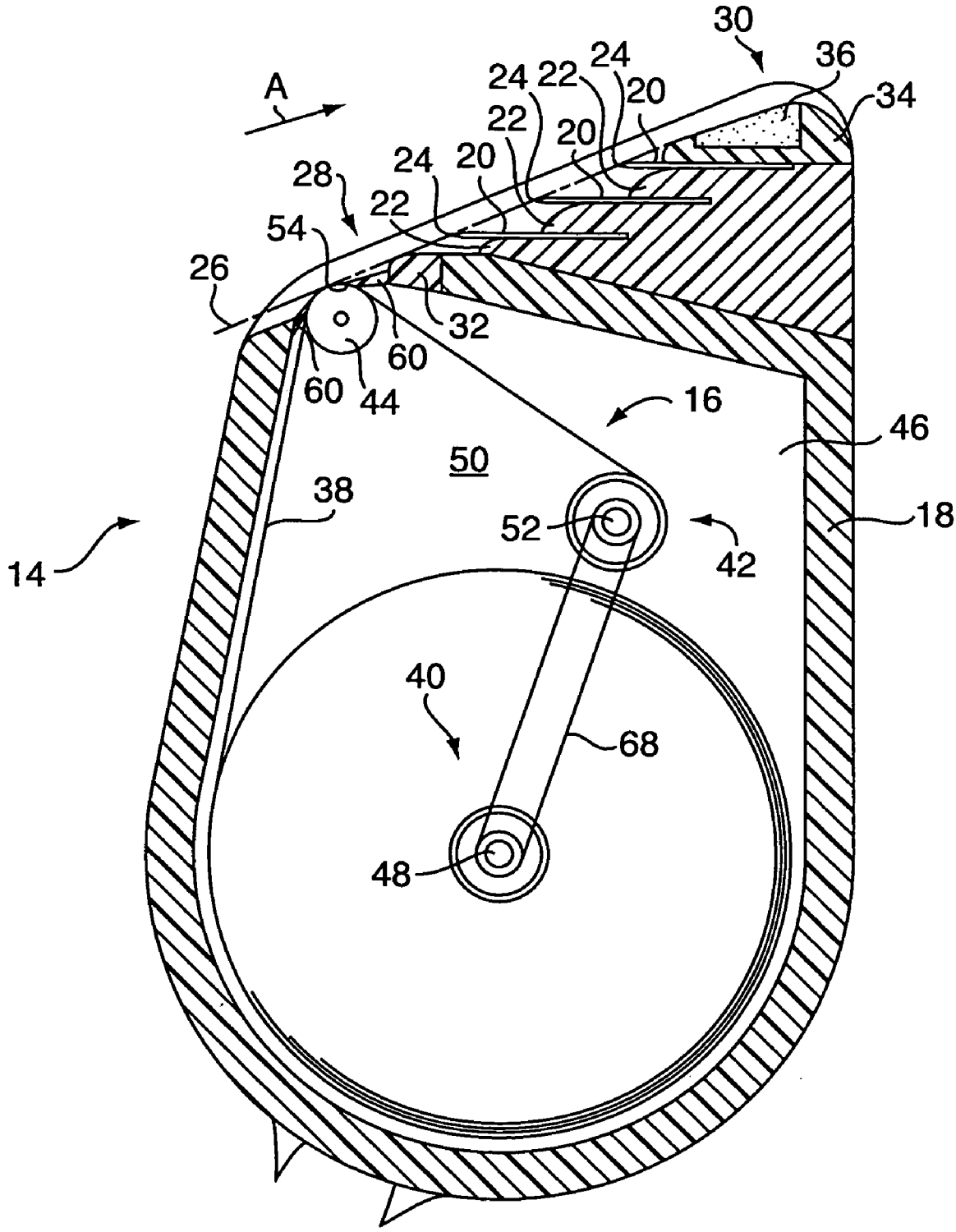
FIG. 6 is a cross-sectional view of a razor cartridge showing a shaving aid dispenser in accordance with another alternate embodiment of the present invention.

The applicator 44 could alternatively be fixed to the housing and need not have the shape of a roller. For example, as shown in FIG. 5, the applicator 44 is a fixed beak-like projection. In such a fixed design, the friction between the shaving aid layer 58 and the skin surface is more critical in advancing the film 38. However, the shape of the projection 44 continues to effect a peeling away of the shaving aid layer 58 as it contacts the skin surface so long as the base substrate 56 is sufficiently tensioned and drawn over the projection 44. In another embodiment, the projection 44 can be adapted to pivot within the opening 54 so as to aid in advancement of the film 38.

The shaving aid layer 58 may be continuously and uniformly coated across the width of the base substrate 56. Alternatively, the shaving aid layer 58 may be variably coated as desired—e.g., more shaving aid in the center of the film 38 than on the edges. Still further, additional layers of shaving aid can be provided on the film 38. For example, a second, higher friction coating may be applied to ensure sufficient friction between the film 38 and the skin surface to adequately advance the film 38 through the shaving aid dispenser system 16. Also, the shaving aid film 38 preferably extends along the length of the blades 20 as shown in FIG. 1.

Any number of known lubricating and/or moisturizing elements may be utilized in the formation of the shaving aid layer 58, including oils, creams, soap and soap-like formulations. Various materials have been used in the prior art as shaving aids and may also be used in connection with the present invention. The shaving aid may comprise one of various combinations of the following:

A. A lubricating agent for reducing the frictional forces between the razor and the skin, e.g., a microencapsulated silicone oil.

B. An agent which reduces the drag between the razor parts and the shaver's face, e.g., a polyethylene oxide in the range of molecular weights between 100,000 and 6 million; a non-ionic polyacrylamide; and/or a natural polysaccharide derived from plant materials such as guar gum.

C. An agent which modifies the chemical structure of the hair to allow the razor blade to pass through the whiskers very easily, e.g., a depilatory agent is one example.

D. A cleaning agent which allows the whiskers and skin debris to be washed more easily from the razor parts during shaving, e.g., a silicon polyethylene oxide block copolymer and detergent such as sodium lauryl sulphate.

E. A medicinal agent for killing bacteria, or repairing skin damage and abrasions.

F. Cosmetic agent for softening, smoothing, conditioning or improving the skin.

G. A blood coagulant for the suppression of bleeding that occurs from nicks and cuts.

H. An astringent for constricting blood vessels thereby stemming the flow of bodily fluids such as lymph which may exude from skin which has been irritated during shaving.

Alternatively, the shaving aid may comprise one or more of these shaving aids disclosed in U.S. Pat. Nos. 5,095,619, 5,056,221, and 4,044,120, which are also incorporated herein by reference.

Other activate ingredients may include various pigments, e.g., titanium dioxide, fragrances, aloe vera, flavoring agents, mineral oils, essential oils and other oils derived from plants. In addition to one or more active ingredients, the shaving aids of the present invention may also comprise other compounds or blends of compounds such as water insoluble polymers such as polystyrene and polypropylene.

Figure 7:
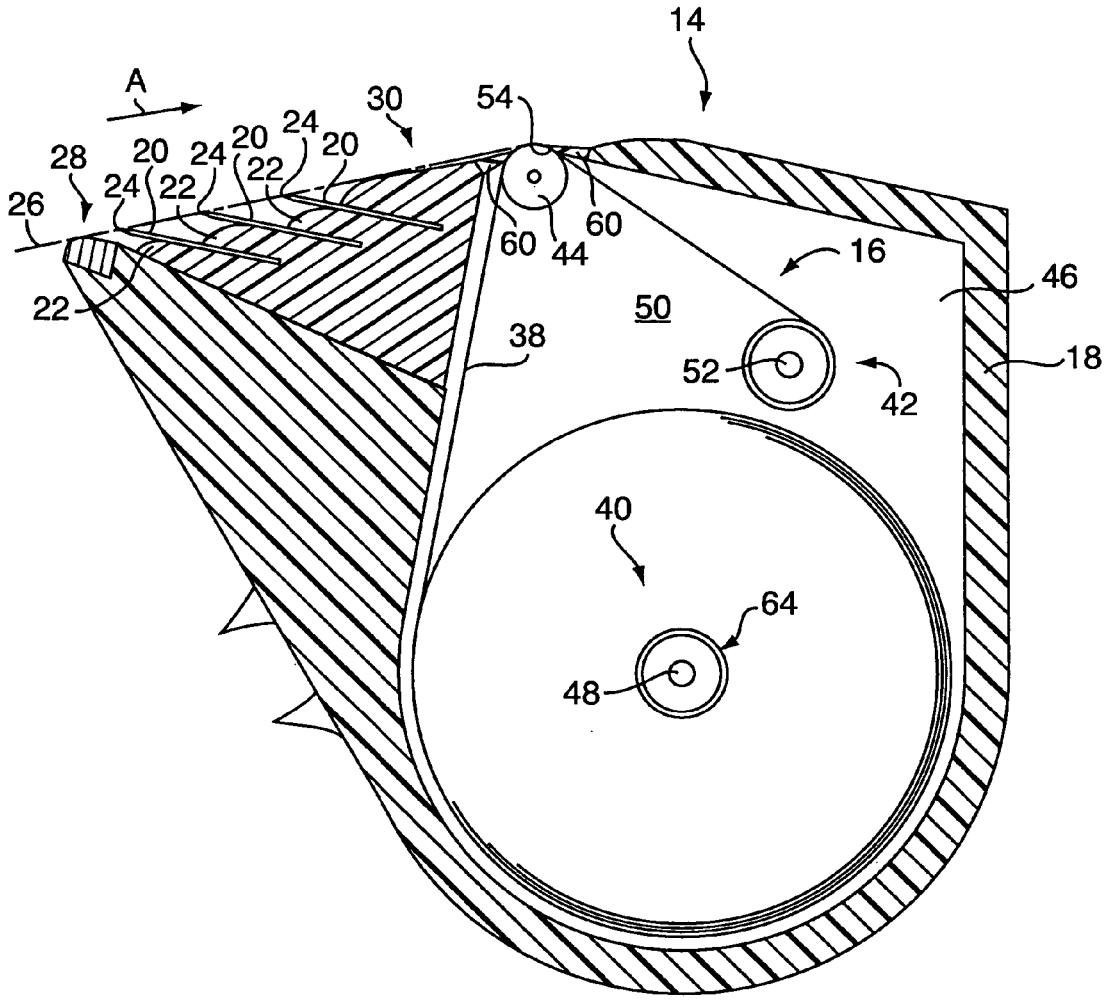
FIG. 7 is a cross-sectional view of an alternate razor cartridge showing a shaving aid dispenser system in accordance with an embodiment of the present invention.

While the present invention has been described in conjunction with a razor 10 where the application of shaving aid to the skin surface is proximate the leading surface 28 of the razor cartridge 14 during use, the present invention is not limited in this regard. As shown in FIG. 2, the shaving aid is applied forward of the blades 20 in order to contact and lubricate the skin of a user prior to the blades 20 acting on any hair protruding therefrom. FIG. 7 shows an alternate razor cartridge embodiment incorporating a shaving aid dispenser system 16 in accordance with the present invention and as described above. The shaving aid may be applied rearward of the blades 20, in place of the cap 34 and the shaving aid comfort strip 36, in order to contact and treat the skin after the blades 20 act on any hair protruding therefrom. Still further, the razor 10 may include both forward and rearward application of shaving aid using shaving aid dispenser systems 16, as discussed herein, without departing from the broader aspects of the present invention. Also, the shaving aid dispenser system may be provided between blades 20 mounted in the razor cartridge without departing from the broader aspects of the present invention. This is especially useful when the razor cartridge is adapted for bi-directional shaving with inwardly facing razor blades.

The present invention may also be incorporated in a razor where the handle is integrally formed with the razor cartridge, as shown in FIG. 8. A razor 110 is shown as having a handle portion 112 integrally formed with a razor cartridge portion 114. Multiple blades 120 are mounted in the razor cartridge portion 114, while a shaving aid dispenser system 116 similar to the system discussed above can be mounted within a cavity formed in the handle portion 112 and capable of drawing a supply of shaving aid film 138 over an applicator 144 in response to the razor 110 being moved over and in contact with a user's skin during a shaving operation. The razor 110 can be further adapted so that the shaving aid dispenser system 116 is contained within the handle portion 112 and the razor cartridge portion 114 is replaceably attached to the handle portion 112. The components of the embodiment shown in FIG. 8 are substantially the same as those shown in the embodiments of FIGS. 1–7 and discussed in more detail above.

While the invention had been described with reference to the preferred embodiments, it will be understood by those skilled in the art that various obvious changes may be made, and equivalents may be substituted for elements thereof, without departing from the essential scope of the present invention. Therefore, it is intended that the invention not be limited to the particular embodiments disclosed, but that the invention includes all embodiments falling within the scope of the appended claims.

What is claimed is:

1. A razor cartridge comprising: at least one razor blade having a cutting edge defining a shave plane; and a dispenser system for applying shaving aid to a skin surface during a shaving operation, said dispenser system comprising: a housing defining a cavity and an opening proximate the at least one blade; a supply reel having shaving aid film wound thereabout and rotatably positioned in the cavity; a take-up reel rotatably positioned in the cavity for collecting used shaving aid film; and an applicator coupled to the housing and having at least a portion extending outwardly from the opening; and wherein the shaving aid film travels along a path from the supply reel around the portion of the applicator extending outwardly from the housing to the take-up reel.

2. The razor cartridge of claim 1, wherein the shaving aid film comprises a base substrate and a shaving aid layer coated thereon.

3. The razor cartridge of claim 2, wherein the shaving aid layer is substantially released from the base substrate upon interaction with the skin surface.

4. The razor cartridge of claim 1, wherein the shaving aid film is advanced from the supply reel to the take-up reel by friction between the skin surface and the shaving aid film at the portion of the applicator extending outwardly from the housing.

5. The razor cartridge of claim 4, wherein the applicator is movable to assist in advancement of the shaving aid film.

6. The razor cartridge of claim 5, wherein the applicator is a roller mounted for rotation to the housing.

7. The razor cartridge of claim 1, wherein the at least one blade is mounted in the housing so that the shaving aid film fed around the portion of the applicator extending outwardly from the housing is substantially in the shave plane of said blade.

8. The razor cartridge of claim 7, said razor cartridge having a leading surface and a trailing surface corresponding to the movement direction of the razor cartridge in the shave plane during shaving, wherein the applicator is mounted on the leading surface side of the cutting edge of the blade.

9. The razor cartridge of claim 7, said razor cartridge having a leading surface and a trailing surface corresponding to the movement direction of the razor cartridge in the shave plane during shaving, wherein the applicator is mounted on the trailing surface side of the cutting edge of the blade.

10. The razor cartridge of claim 1, wherein the shaving aid film is maintained in tension between the supply reel and the take-up reel.

11. The razor cartridge of claim 10, wherein the take-up reel is biased to maintain a tension in the shaving aid film.

12. The razor cartridge of claim 10, wherein the rotation of one of the supply reel and the take-up reel effects the rotation of the other of the supply reel and the take-up reel to maintain a tension in the shaving aid film.

13. The razor cartridge of claim 10, wherein the supply reel and the take-up reel are ratcheted so as to restrict rotation to one direction.

14. A shaving aid dispenser system for use in a wet shave razor assembly comprising: a housing defining a cavity; a supply of shaving aid film disposed in said cavity, the shaving aid film comprising a substrate having a layer of a shaving aid; an applicator coupled to the housing; means defining an application path for drawing the shaving aid film over the applicator in response to the shaving aid film being moved over and in contact with a user's skin during a shaving operation, thereby depositing the shaving aid onto the user's skin, wherein the means defining an application path includes: a supply reel rotatably supported within the cavity, the supply of shaving aid film being wound around the supply reel; a take-up reel rotatably supported within the cavity for collecting used shaving aid film; and wherein the shaving aid film extends from the supply reel over at least a portion of the applicator to the take-up reel.

15. The shaving aid dispenser system of claim 14, wherein the housing has an opening, at least a portion of the applicator partially extending out of said opening.

16. The shaving aid dispenser system of claim 15, wherein the shaving aid film is advanced from the supply reel to the take-up reel by friction between the skin surface and the shaving aid film at the portion of the applicator extending outwardly from the housing.

17. The shaving aid dispenser system of claim 16, wherein the applicator is movable to assist in advancement of the shaving aid film.

18. The shaving aid dispenser system of claim 17, wherein the applicator is a roller mounted for rotation in the housing.

19. The shaving aid dispenser system of claim 14, wherein the shaving aid layer is substantially released from the base substrate upon contact with the user's skin.

20. The shaving aid dispenser system of claim 14, further comprising at least one razor blade mounted in the housing and having a cutting edge defining a shave plane, and wherein the applicator is coupled to the housing adjacent the at least one razor blade.

21. The shaving aid dispenser system of claim 20, wherein the at least one blade is mounted in the housing so that the shaving aid film drawn over the applicator extending is substantially in the shave plane of said blade.

22. The shaving aid dispenser system of claim 20, said shave plane having a leading side and a trailing side corresponding to the movement direction of the cutting edge in the shave plane during shaving, wherein the applicator is coupled to the housing on the leading side of the cutting edge.

23. The shaving aid dispenser system of claim 20, said shave plane having a leading side and a trailing side corresponding to the movement direction of the cutting edge in the shave plane during shaving, wherein the applicator is coupled to the housing on the trailing side of the cutting edge.

24. The shaving aid dispenser system of claim 14, wherein the shaving aid film is maintained in tension between the supply reel and the take-up reel.

25. The shaving aid dispenser system of claim 14, a wherein the take-up reel is biased to maintain a tension in the shaving aid film.

26. The shaving aid dispenser system of claim 14, wherein the rotation of one of the supply reel and the take-up reel effects the rotation of the other of the supply reel and the take-up reel to maintain a tension in the shaving aid film.

27. The shaving aid dispenser system of claim 14, wherein the supply reel and the take-up reel are ratcheted so as to restrict rotation in one direction.

28. A razor assembly comprising: a handle; a razor cartridge attached to said handle, said razor cartridge including at least one razor blade; and a shaving aid dispenser system for applying a shaving aid to a skin surface, said shaving aid dispenser system comprising: a supply reel containing a supply of shaving aid film mounted for rotation about a supply reel axis; a take-up reel mounted for rotation about a take-up reel axis for collecting used shaving aid film; an applicator proximate the at least one blade for transferring shaving aid from the shaving aid film to the skin surface upon contact between the shaving aid film and the skin surface; wherein the shaving aid film is drawn along an application pat between the supply reel and the take-up reel over the applicator in response to the razor cartridge being moved over and in contact with the skin surface during a shaving operation, thereby depositing the shaving aid onto the skin surface.

29. A razor cartridge having a shaving aid dispenser system comprising: a housing defining a cavity; at least one razor blade positioned in the housing and having a cutting edge that is at least partially exposed; a supply of shaving aid film positioned in said cavity, the shaving aid film comprising a substrate having a layer of a shaving aid; an applicator coupled to the housing adjacent the cutting edge of the razor blade; and means defining an application path for drawing the shaving aid film over the applicator in response to the razor cartridge being moved over and in contact with a user's skin during a shaving operation, thereby depositing the shaving aid onto the user's skin, wherein the means defining an application path includes: a supply reel rotatably supported within the cavity, the supply of shaving aid film being wound around the supply reel; a take-up reel rotatably supported within the cavity for collecting used shaving aid film; and wherein the shaving aid film extends from the supply reel over at least a portion of the applicator to the take-up reel.

30. The razor cartridge of claim 29, wherein the housing includes an opening adjacent the cutting edge of the razor blade, the portion of the applicator over which the shaving aid film is drawn extending outwardly from said opening.

31. The razor cartridge of claim 29, wherein the shaving aid layer is substantially released from the base substrate upon interaction with the user's skin.

32. The razor cartridge of claim 30, wherein the shaving aid film is advanced from the supply reel to the take-up reel by friction between the shaving aid film and the user's skin at the portion of the applicator extending outwardly from the opening in the housing.

33. The razor cartridge of claim 32, wherein the applicator is movable to assist in advancement of the shaving aid film.

34. The razor cartridge of claim 33, wherein the applicator is a roller mounted for rotation to the housing.

35. The razor cartridge of claim 30, wherein the cutting edge of the at least one blade defines a shave plane corresponding to the movement direction of the cutting edge over the user's skin during a shaving operation, the shaving aid film drawn over the portion of the applicator extending outwardly from the opening in the housing being substantially in the shave plane.

36. The razor cartridge of claim 35, the housing having a leading surface and a trailing surface corresponding to the movement direction of the cutting edge in the shave plane during a shaving operation, wherein the applicator is mounted on the leading surface side of the cutting edge of the blade.

37. The razor cartridge of claim 35, the housing having a leading surface and a trailing surface corresponding to the movement direction of the cutting edge in the shave plane during a shaving operation, wherein the applicator is mounted on the trailing surface side of the cutting edge of the blade.

38. The razor cartridge of claim 29, wherein the shaving aid film is maintained in tension between the supply reel and the take-up reel.

39. The razor cartridge of claim 38, wherein the take-up reel is biased to maintain a tension in the shaving aid film.

40. The razor cartridge of claim 38, wherein the rotation of one of the supply reel and the take-up reel effects the rotation of the other of the supply reel and the take-up reel to maintain a tension in the shaving aid film.

41. The razor cartridge of claim 38, wherein the supply reel and the take-up reel are ratcheted so as to restrict rotation to one direction.

42. A razor assembly comprising: a handle; and a razor cartridge attached to said handle, said razor cartridge including: at least one razor blade having a cutting edge that is at least partially exposed; and a shaving aid dispenser system for applying a shaving aid to a skin surface, said shaving aid dispenser system comprising: a housing defining a cavity; a supply of shaving aid film positioned in said cavity, the shaving aid film comprising a substrate having a layer of a shaving aid; an applicator coupled to the housing adjacent the cutting edge of the razor blade; and means defining an application path for drawing the shaving aid film over the applicator in response to the razor cartridge being moved over and in contact with a user's skin during a shaving operation, thereby depositing the shaving aid onto the user's skin, wherein the means defining an application path includes: a supply reel rotatably supported within the cavity, the supply of shaving aid film being wound around the supply reel; a take-up reel rotatably supported within the cavity for collecting used shaving aid film; and wherein the shaving aid film extends from the supply reel over at least a portion of the applicator to the take-up reel.

* * * * *